US011646524B2

(12) United States Patent
Yoshiura

(10) Patent No.: US 11,646,524 B2
(45) Date of Patent: May 9, 2023

(54) CABLE CONNECTOR AND METHOD FOR MANUFACTURING CABLE CONNECTOR

(71) Applicant: SMK Corporation, Tokyo (JP)

(72) Inventor: Yasuo Yoshiura, Kanagawa (JP)

(73) Assignee: SMK Corporation, Tokyo (JP)

( * ) Notice: Subject to any disclaimer, the term of this patent is extended or adjusted under 35 U.S.C. 154(b) by 9 days.

(21) Appl. No.: 17/346,294

(22) Filed: Jun. 13, 2021

(65) Prior Publication Data

US 2022/0181818 A1 Jun. 9, 2022

(30) Foreign Application Priority Data

Dec. 8, 2020 (JP) ..... JP2020-203405

(51) Int. Cl.
*H01R 13/52* (2006.01)
*H01R 43/20* (2006.01)
*H01R 13/432* (2006.01)

(52) U.S. Cl.
CPC ..... *H01R 13/5205* (2013.01); *H01R 13/432* (2013.01); *H01R 43/20* (2013.01)

(58) Field of Classification Search
CPC .. H01R 9/0518; H01R 13/432; H01R 13/502; H01R 13/5205; H01R 13/5804; H01R 43/20
See application file for complete search history.

(56) References Cited

U.S. PATENT DOCUMENTS 4,634,208 A * 1/1987 Hall ..... H01R 13/6594 439/607.51
4,799,902 A * 1/1989 Laudig ..... H01R 24/562 439/585
7,909,647 B2 * 3/2011 Kawaguchi ..... H01R 13/65915 439/585
9,537,231 B2 * 1/2017 Hall ..... H01R 13/434
10,594,057 B2 * 3/2020 Kanemura ..... H01R 43/16
2004/0018771 A1 * 1/2004 Togashi ..... H01R 9/0518 439/578
2012/0202372 A1 * 8/2012 Hardy ..... H01R 24/40 439/585
2017/0110838 A1 * 4/2017 Sasaki ..... H01R 13/5205

FOREIGN PATENT DOCUMENTS

JP 2014017181 A 1/2014
JP 2019200898 A 11/2019
JP 2020092063 A 6/2020

OTHER PUBLICATIONS

Office Action issued for counterpart Japanese Application No. 2020-203405, issued by the Japan Patent Office dated Oct. 26, 2021 (drafted on Oct. 20, 2021).

* cited by examiner

*Primary Examiner* — Oscar C Jimenez

(57) ABSTRACT

A cable connector can suppress an increase in machining cost and restrict variations in quality while preventing loosening of the caulking, stabilizing conduction with a conductive part of the cable, and preventing a decrease in the fixing strength to the cable. A cable connector includes a conductive contact that is connected to an internal conductive part; an insulating insulator that holds the contact; a conductive shell that includes a caulking section caulked to an external insulating part and covers the insulator; and a cylindrical conductive outer sleeve that is located over the caulking section and caulked to the external insulating part via the caulking section.

3 Claims, 6 Drawing Sheets

CABLE CONNECTOR AND METHOD FOR MANUFACTURING CABLE CONNECTOR

CROSS REFERENCE TO RELATED APPLICATION

The contents of the following Japanese patent application are incorporated herein by reference, Japanese Patent Application NO. 2020-203405 filed on Dec. 8, 2020.

FIELD

The present invention relates to a cable connector connected to a cable and a method for manufacturing the cable connector.

BACKGROUND

Automotive and other cable connectors desirably have high cable tensile strength, and improved strength has been demanded of cable connections heretofore.

Patent Literature 1 discloses a configuration related to a connector terminal fixed to a cable. In the disclosed configuration, a sleeve is located on the outer perimeter of a cable jacket, a shield braid in the cable is folded back over the outer perimeter of the sleeve, and a shield shell barrel is further caulked thereto from outside. However, since the cable jacket of the connector terminal disclosed in Patent Literature 1 is thick and elastic, there are concerns that application of a load toward the opening direction of the sleeve and the barrel can loosen the caulking and make the conduction between the shield and the barrel unstable, and that the fixing strength between the cable and the connector terminal can decrease.

In view of this, a cable connector in which a caulking section is soldered has been developed in order to resolve these foregoing concerns.

CITATION LIST

Patent Literature

Patent Literature 1: Japanese Patent Application Laid-Open No. 2020-092063

SUMMARY

Technical Problem

However, the cable connector with a soldered caulking section has problems of increasing machining cost and creating variations in quality.

An object of the present invention is to provide a cable connector that can suppress an increase in machining cost and variations in quality while preventing loosening of the caulking, stabilizing conduction with a conductive part of the cable, and preventing a decrease in the fixing strength to the cable.

Solution to Problem

A cable connector according to a first aspect of the present invention is a cable connector connected to a cable including a conductive part and an insulating part covering the conductive part. The cable connector includes: a conductive contact that is connected to the conductive part; an insulating insulator that holds the contact; a conductive shell that includes a caulking section caulked to the insulating part and covers the insulator; and a cylindrical conductive first sleeve that is located over the caulking section and caulked to the insulating part via the caulking section.

A method for manufacturing a cable connector according to a second aspect of the present invention is a method for manufacturing a cable connector connected to a cable including a conductive part and an insulating part covering the conductive part. The method includes the steps of: connecting a conductive contact to the conductive part; holding the contact by an insulating insulator; covering the insulator with a main body section of a conductive shell and caulking a caulking section of the shell to the insulating part; and locating a cylindrical conductive sleeve over the caulking section and then caulking the sleeve to the insulating part via the caulking section.

If a force in a direction of loosening the caulking of the caulking section is applied from the insulating part of the cable etc., the cylindrical first sleeve suppresses the force in the direction of loosening the caulking of the caulking section.

According to the aspect(s) of the present invention, an increase in machining cost and variations in quality can be suppressed while preventing loosening of the caulking, stabilizing conduction with the conductive part of the cable, and preventing a decrease in the fixing strength to the cable.

DESCRIPTION OF EMBODIMENTS

Figure 1:
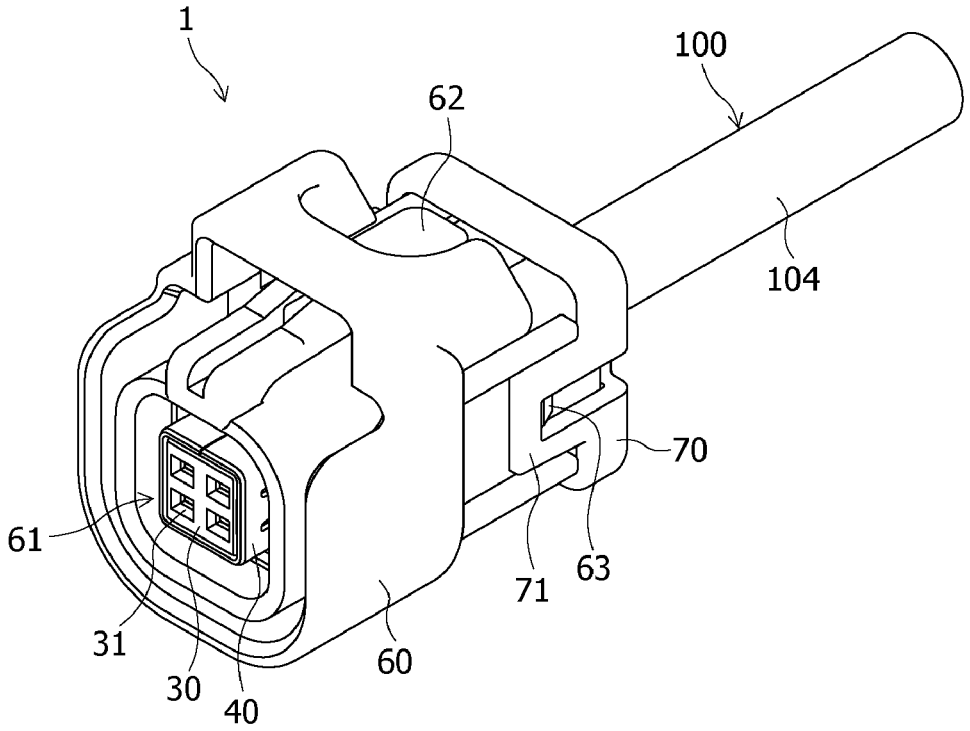
FIG. 1 is a perspective view of a cable connector according to an embodiment of the present invention.

A cable connector according to an embodiment of the present invention will be described in detail below with reference to the drawings as appropriate.

<Configuration of Cable Connector>

A configuration of a cable connector 1 according to the embodiment of the present invention will be described in detail below with reference to FIGS. 1 to 11. In the following description, the leftward direction in FIGS. 2 and 8 will be referred to as a forward direction, and the rightward direction in FIGS. 2 and 8 a backward direction.

The cable connector 1 is connected to a cable 100, and includes contacts 10, an inner sleeve 20, an insulator 30, a shell 40, an outer sleeve 50, a housing 60, and a cover 70.

The cable 100 includes a plurality of internal conductive parts 101, a plurality of internal insulating parts 102 covering the respective plurality of internal conductive parts 101, a braid part 103 serving as an external conductive part covering the internal insulating parts 102, and an external insulating part 104 covering the braid part 103. In the illustrated example, the number of internal conductive parts 101 is four.

Figure 3:
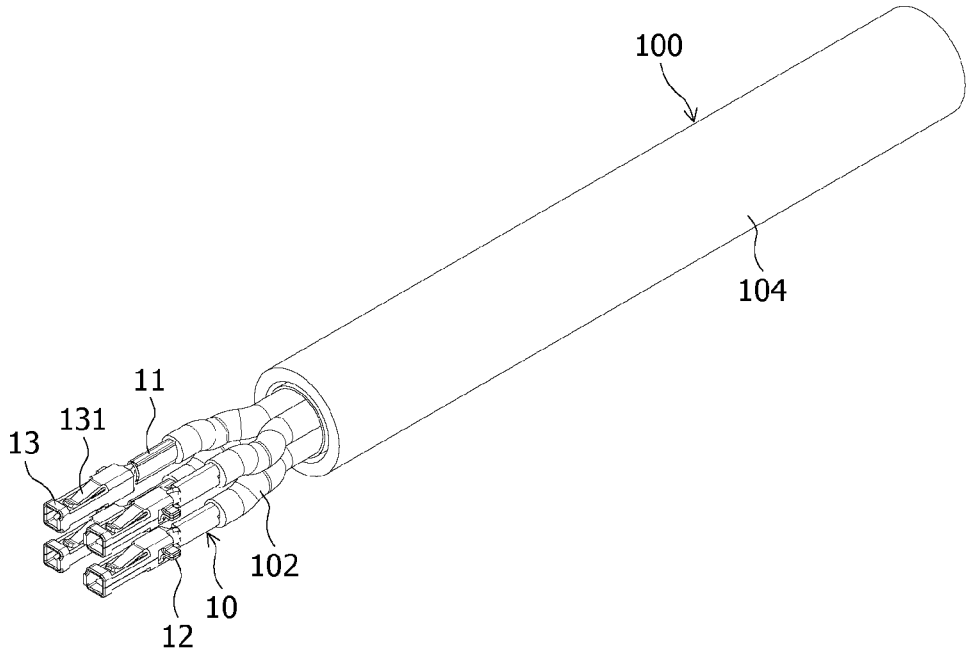
FIG. 3 is a perspective view illustrating a state where internal conductive parts of a cable are connected to contacts in a manufacturing process of the cable connector according to the embodiment of the present invention.
Figure 4:
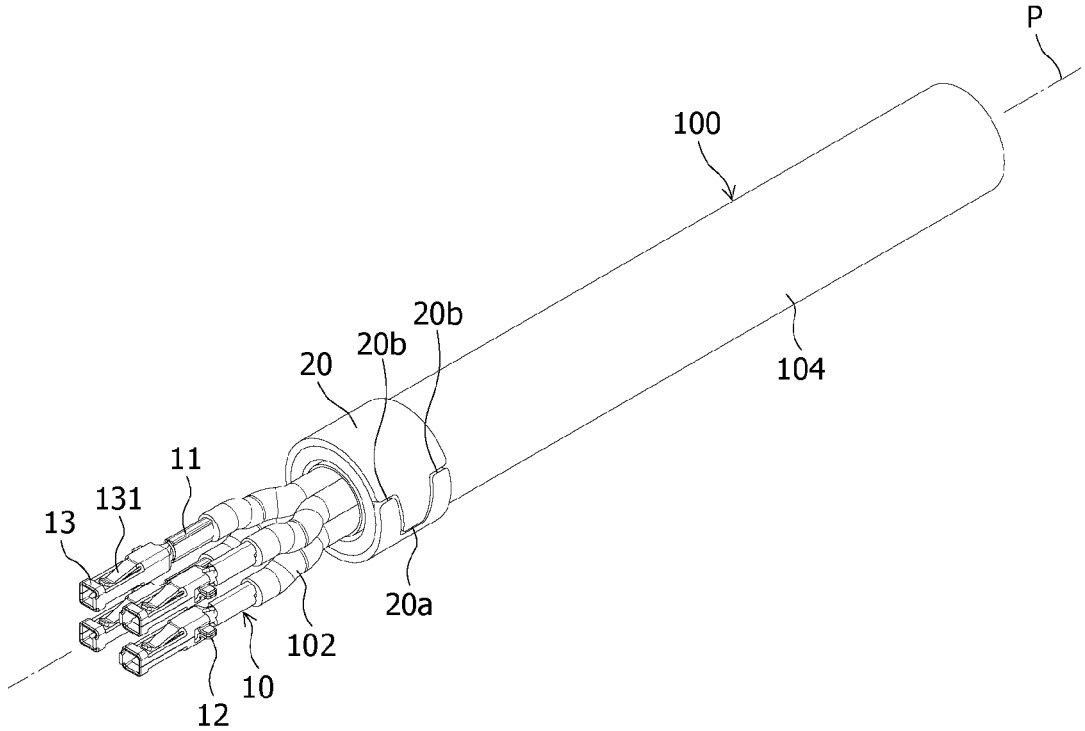
FIG. 4 is a perspective view illustrating a state where an inner sleeve is caulked to an external insulating part of the cable in the manufacturing process of the cable connector according to the embodiment of the present invention.
Figure 5:
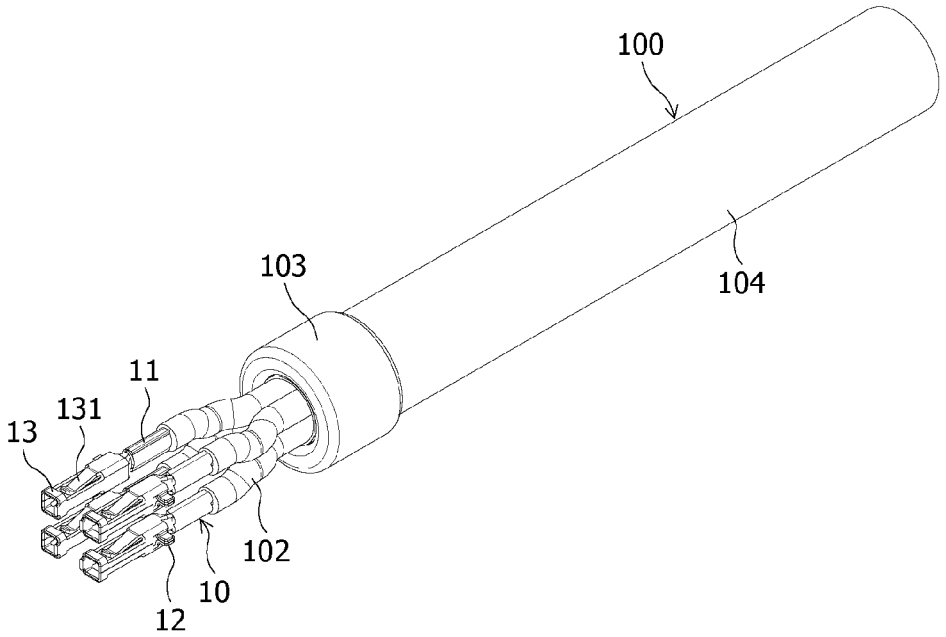
FIG. 5 is a perspective view illustrating a state where a braid part of the cable is folded back over the outer perimeter of the inner sleeve in the manufacturing process of the cable connector according to the embodiment of the present invention.

The contacts 10 are made of a conductive material. As illustrated in FIGS. 3 to 5, the contacts 10 each include a fixing section 11, an engaging section 12, and a connection section 13.

The fixing sections 11 are fixed and connected to the internal conductive parts 101 of the cable 100.

The engaging sections 12 are each formed by stamping a metal plate and bending the metal plate outward. The engaging sections 12 are engaged with the insulator 30, whereby the contacts 10 are held by the insulator 30.

The connection sections 13 are connected to conductive contacts of a not-illustrated counterpart connector by elastic force. The connection sections 13 each include a connection piece 131 that is formed by stamping a metal plate and bending the metal plate inward. The connection pieces 131 are connected to the conductive contacts of the counterpart connector with elastic deformation.

The inner sleeve 20 is made of a conductive material and has an open barrel configuration. The inner sleeve 20 is located between the external insulating part 104 and a caulking section 42 of the shell 40 later described. The inner sleeve 20 is cylindrically caulked to the external insulating part 104 of the cable 100. The caulked inner sleeve 20 has a circular cross section when cut by a plane orthogonal to an axis P of the cable 100 illustrated in FIG. 4. As illustrated in FIG. 5, the braid part 103 of the cable 100 is folded back over the outer perimeter of the inner sleeve 20.

Figure 6:
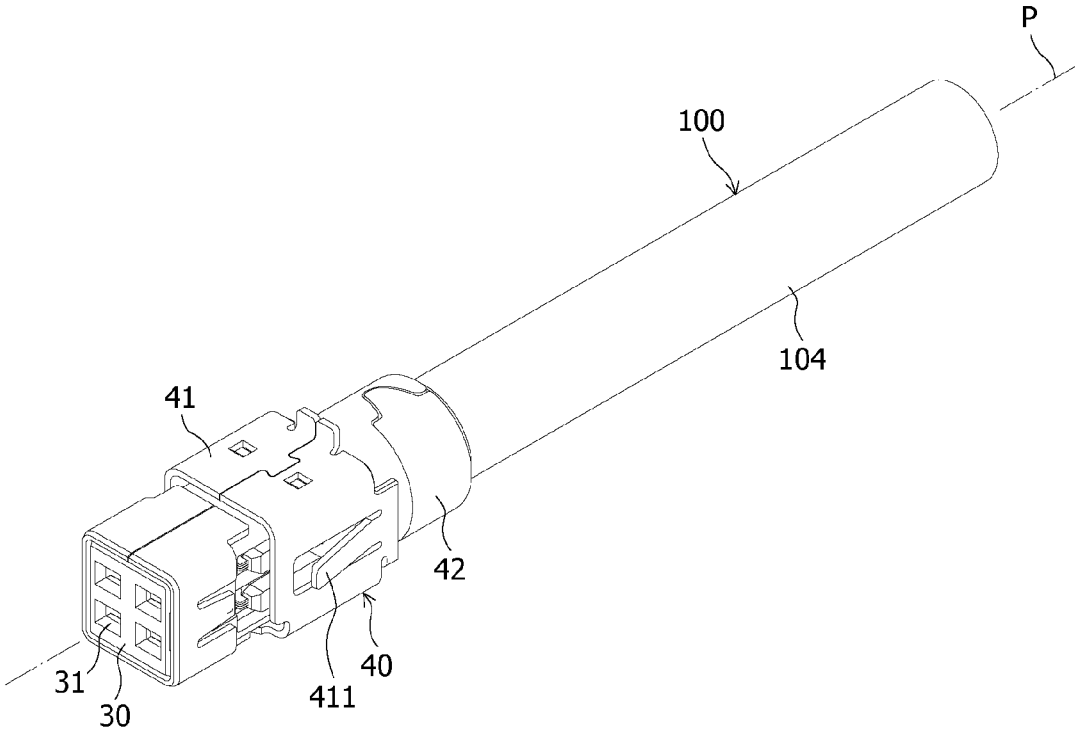
FIG. 6 is a perspective view illustrating a state where the contacts are held by an insulator and a shell is caulked to the braid part of the cable in the manufacturing process of the cable connector according to the embodiment of the present invention.

The insulator 30 is made of an insulating material and has a rectangular shape as illustrated in FIG. 6. The insulator 30 has through holes 31 running through in the front-to-back direction. The through holes 31 hold the contacts 10 in a mutually insulated state, and enable insertion of the not-illustrated conductive contacts of the counterpart connector from the front.

Figure 7:
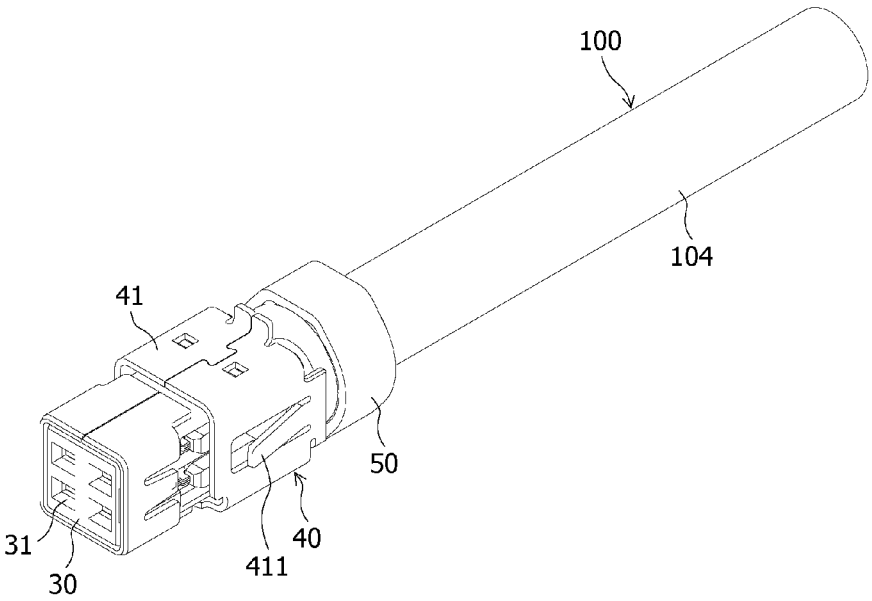
FIG. 7 is a perspective view illustrating a state where an outer sleeve is caulked to the shell in the manufacturing process of the cable connector according to the embodiment of the present invention.
Figure 8:
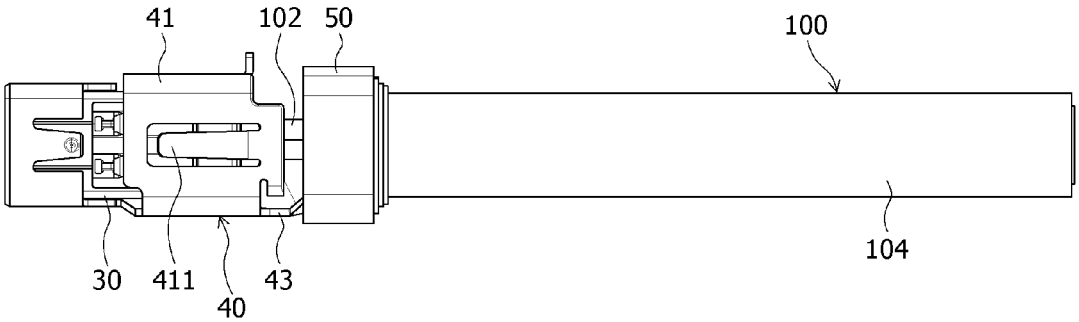
FIG. 8 is a plan view illustrating the state where the outer sleeve is caulked to the shell in the manufacturing process of the cable connector according to the embodiment of the present invention.
Figure 9:
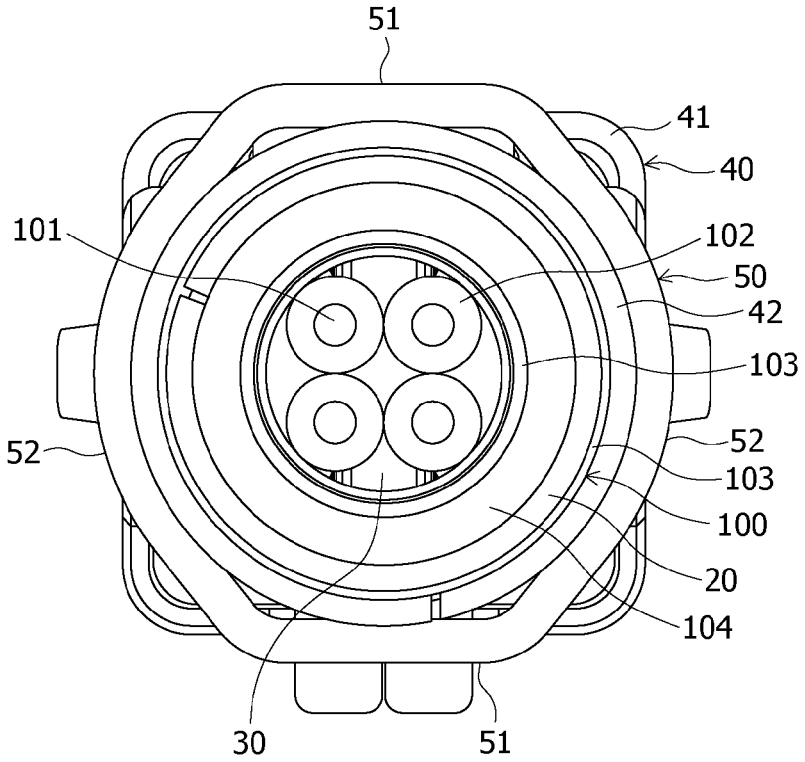
FIG. 9 is a rear view illustrating the state where the outer sleeve is caulked to the shell in the manufacturing process of the cable connector according to the embodiment of the present invention.
Figure 10:
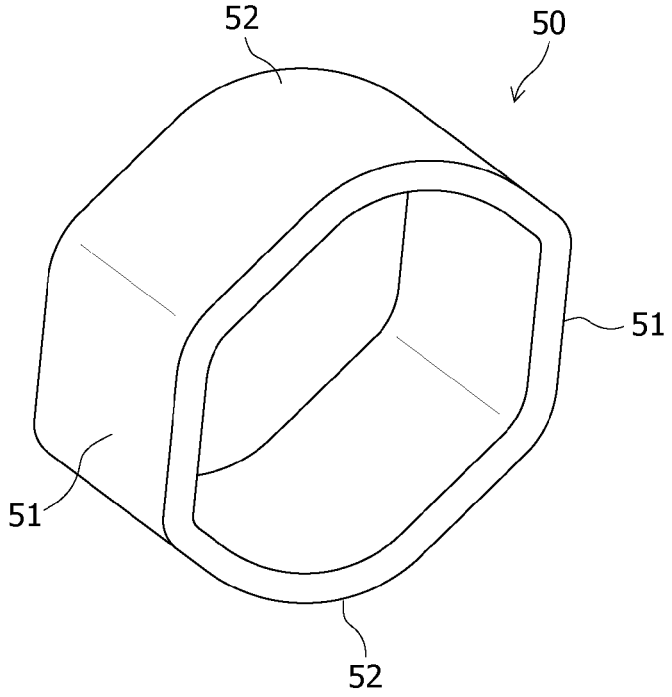
FIG. 10 is a perspective view of the outer sleeve of the cable connector according to the embodiment of the present invention.

The shell 40 is made of a conductive material, and includes a main body section 41, the caulking section 42, and a connection section 43 as illustrated in FIGS. 6 to 8.

The main body section 41 covers the insulator 30. The main body section 41 includes engaging pieces 411 formed by cutting and erecting outward a metal plate. The main body section 41 is connected to a conductive part of the not-illustrated counterpart connector.

The caulking section 42 has an open barrel configuration and is located between the inner sleeve 20 and the outer sleeve 50. The caulking section 42 is caulked to the external insulating part 104 via the inner sleeve 20 so that the braid part 103 of the cable 100 folded back over the outer perimeter of the inner sleeve 20 is sandwiched between the caulking section 42 and the inner sleeve 20. The caulking section 42 is cylindrically caulked to the external insulating part 104 of the cable 100. The caulking section 42 is caulked to have a circular cross section when cut by a plane orthogonal to the axis P of the cable 100 illustrated in FIG. 6.

The connection section 43 connects the main body section 41 to the caulking section 42.

Figure 11:
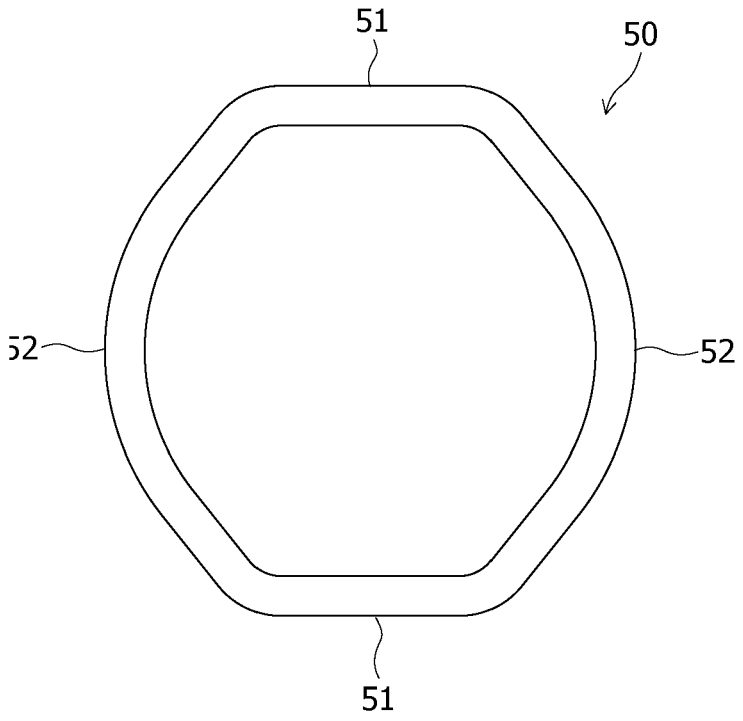
FIG. 11 is a front view of the outer sleeve of the cable connector according to the embodiment of the present invention.

The outer sleeve 50 is made of a conductive material. As illustrated in FIGS. 7 to 11, the outer sleeve 50 has a circumferentially seamless, cylindrical (pipe-like) closed barrel configuration. The outer sleeve 50 includes straight wall sections 51 and curved wall sections 52. The straight wall sections 51 are extended in parallel and situated opposed to each other. The curved wall sections 52 are curved to bulge outward and situated opposed to each other, and are continuous with the straight wall sections 51. As illustrated in FIG. 11, the outer sleeve 50 has a substantially hexagonal shape. The outer sleeve 50 is located over the caulking section 42, and caulked to the external insulating part 104 of the cable 100 via the inner sleeve 20 and the caulking section 42 sandwiching the braid part 103 therebetween.

The outer sleeve 50 is not limited to the hexagonal shape illustrated in FIG. 11, and may have any shape such as an octagonal shape. While the outer sleeve 50 in FIG. 9 has a substantially hexagonal shape, the outer sleeve 50 is in fact, plastically deformed by caulking.

Figure 2:
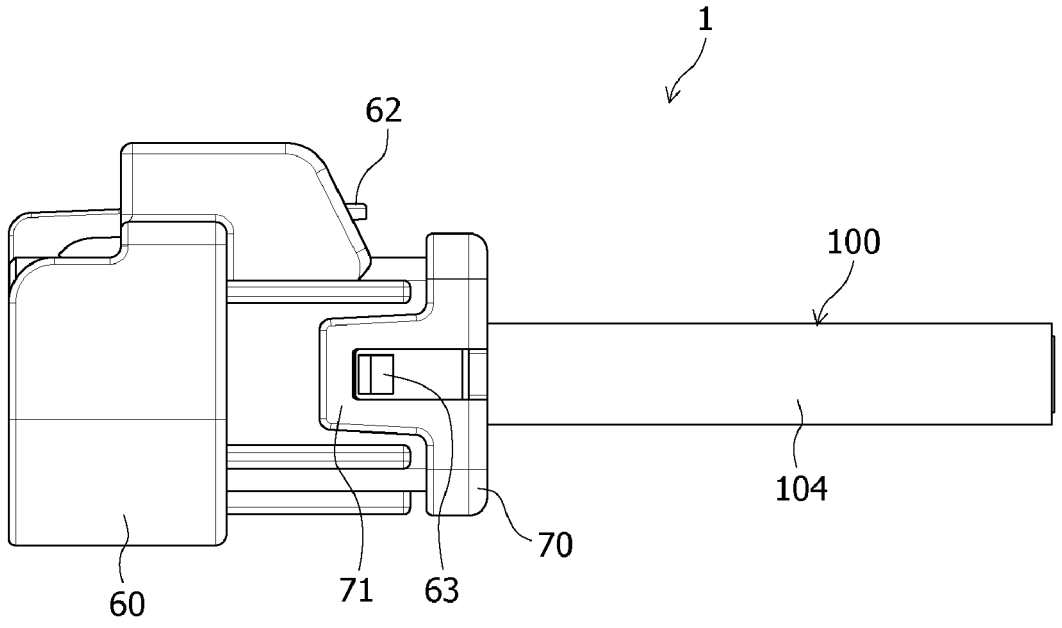
FIG. 2 is a side view of the cable connector according to the embodiment of the present invention.

As illustrated in FIGS. 1 and 2, the housing 60 is engaged with the engaging pieces 411 of the shell 40 and thereby attached to the shell 40 to cover the shell 40. The housing 60 includes an opening 61, a mating piece 62, and engaging protrusions 63.

The opening 61 is opened in the front end and exposes the insulator 30 to the outside. The not-illustrated counterpart connector is inserted into the opening 61.

The mating piece 62 is elastically deformable. The mating piece 62 is elastically deformed and mated with a not-illustrated lock part of the counterpart connector, whereby the cable connector 1 and the counterpart connector are connected.

The engaging protrusions 63 are located on the rear end side and protruded outward.

As illustrated in FIGS. 1 and 2, the cover 70 includes elastically deformable engaging pieces 71. The engaging pieces 71 are engaged with the engaging protrusions 63 of the housing 60, whereby the cover 70 is attached to the housing 60 to cover the rear portion of the housing 60.

<Method for Manufacturing Cable Connector>

A method for manufacturing the cable connector 1 according to the embodiment of the present invention will now be described in detail.

As illustrated in FIG. 3, the contacts 10 are initially connected to the respective internal conductive parts 101 of the cable 100 by fixing the fixing sections 11 of the contacts 10 thereto.

Next, the external insulating part 104 of the cable 100 is partly cut off to expose the braid part 103 from the external insulating part 104. The external insulating part 104 of the cable 100 is then inserted through the inner sleeve 20, and the inner sleeve 20 is caulked to the external insulating part 104 as illustrated in FIG. 4. The exposed braid part 103 is omitted in FIG. 4.

Here, the inner sleeve 20 is caulked to the external insulating part 104 with a circumferential end 20*a* and the other circumferential end 20*b* in contact with each other. This prevents excessive caulking of the inner sleeve 20, whereby disconnection of the cable 100 resulting from caulking can be prevented.

Next, as illustrated in FIG. 5, the exposed braid part 103 of the cable 100 is folded back over the outer perimeter of the inner sleeve 20.

Next, the cable 100 is inserted through the cover 70 and through the outer sleeve 50. The step of inserting the cable 100 through the cover 70 and the step of inserting the cable 100 through the outer sleeve 50 may be performed at any timing before the step of folding back the braid part 103 over the outer perimeter of the inner sleeve 20.

Next, as illustrated in FIG. 6, the connection sections 13 of the contacts 10 are inserted into the through holes 31 of the insulator 30 from behind, and the engaging sections 12 of the contacts 10 are engaged with not-illustrated engaging sections of the insulator 30, whereby the insulator 30 is attached to the cable 100. The step of attaching the insulator 30 to the cable 100 may be performed after the step of inserting the cable 100 through the cover 70 and the step of inserting the cable 100 through the outer sleeve 50 and before the step of folding back the braid part 103 over the outer perimeter of the inner sleeve 20.

Next, as illustrated in FIG. 6, the insulator 30 is covered with a main body section 41 of the shell 40, and the caulking section 42 of the shell 40 is caulked to the external insulating part 104 via the inner sleeve 20 with the braid part 103 sandwiched between the caulking section 42 and the inner sleeve 20. Here, the inner sleeve 20 is cylindrically caulked to the external insulating part 104 of the cable 100 and the caulking section 42 is cylindrically caulked to the external insulating part 104 of the cable 100. The braid part 103 can thus be uniformly sandwiched between the inner sleeve 20 and the caulking section 42 in a balanced manner, maintaining caulking strength and an electrical connection.

Next, the outer sleeve 50 is moved to cover the caulking section 42. As illustrated in FIGS. 7 and 8, the outer sleeve 50 is then caulked to the external insulating part 104 of the cable 100 via the inner sleeve 20 and the caulking section 42 sandwiching the braid part 103 therebetween. Since the inner sleeve 20 is located between the outer sleeve 50 and the external insulating part 104, the force to be applied to the outer sleeve 50 in caulking the outer sleeve 50 can be set somewhat roughly, facilitating manufacturing.

Next, the housing 60 is attached to the shell 40 in order to cover the shell 40.

Next, the cover 70 is moved to the rear of the housing 60 to engage the engaging pieces 71 of the cover 70 with the engaging protrusions 63 of the housing 60, whereby the cable connector 1 is complete.

With the cable connector 1 produced by the abovementioned manufacturing method, the tensile strength of the cable 100 can be improved by sandwiching the braid part 103 between the inner sleeve 20 and the shell 40.

Moreover, the placement of the outer sleeve 50 can prevent the decrease in strength caused by the elastic nature of the external insulating part 104 serving as a cushion and preventing rigidity of the inner sleeve 20 and by force being applied in the loosening direction of the caulking acting on the inner sleeve 20 and the caulking section 42 of the shell 40.

Caulking the external insulating part 104 of the cable 100 via the inner sleeve 20 can maintain caulking strength while avoiding deterioration in signal transmission performance due to excessive caulking and preventing disconnection of the cable 100 resulting from the caulking.

Sandwiching the braid part 103 between the caulking section 42 of the shell 40 and the inner sleeve 20 and caulking the caulking section 42 to the external insulating part 104 can stabilize contact with the braid part 103 and prevent a decrease in caulking strength.

Forming the outer sleeve 50 in the circumferentially seamless cylindrical shape can reliably prevent the inner sleeve 20 and the caulking section 42 of the shell 40 being expanded by the external insulating part 104 and the like.

Incidentally, if the thickness of the shell 40 is increased to improve the caulking strength to the cable 100, the spring property of the shell 40 decreases. This lowers the contact performance between the shell 40 and the counterpart connector, and lowers the attachability of the shell 40 to the insulator 30 and the housing 60.

According to the present embodiment, the caulking section 42 is caulked to the external insulating part 104. The conductive shell 40 covers the insulator 30, and the cylindrical conductive outer sleeve 50 is placed over the caulking section 42 and caulked to the external insulating part 104 via the caulking section 42. The provision of such members can suppress an increase in machining cost and restrict variations in quality while preventing loosening of the caulking, stabilizing conduction with the conductive parts of the cable, and preventing a decrease in the fixing strength to the cable.

It will be understood that the types, arrangement, and number of members according to the present invention are not limited to the aforementioned embodiment, and modifications can be made appropriately without departing from the gist of the invention, like replacing the components with ones of similar operations and effects.

Specifically, in the present embodiment, the cable connector 1 is connected to the cable 100 including the internal conductive parts 101, the internal insulating parts 102, the braid part 103, and the external insulating part 104. However, the present invention is not limited thereto, and the cable connector 1 may be connected to a cable including conductive parts and insulating parts covering the conductive parts.

In the aforementioned embodiment, the cable connector 1 is connected to the cable 100 including four internal conductive parts 101. However, the present invention is not limited thereto, and the cable connector 1 may be configured to connect to a cable including one or a plurality of internal conductive parts other than four.

In the present embodiment, the caulking section 42 of the shell 40 is caulked with the braid part 103 sandwiched between the inner sleeve 20 and the caulking section 42. However, the present invention is not limited thereto, and the caulking section 42 of the shell 40 may be caulked without the braid part 103 sandwiched between the inner sleeve 20 and the caulking section 42.

In the aforementioned embodiment, the cable connector 1 includes the inner sleeve 20. However, the present invention is not limited thereto, and the inner sleeve 20 may be omitted.

The cable connector and the method for manufacturing the cable connector according to the embodiment of the present invention are suitable to suppress an increase in machining cost and restrict variations in quality while preventing loosening of the caulking, stabilizing the conduction with the conductive parts of the cable, and preventing a decrease in the fixing strength to the cable.

REFERENCE SIGNS LIST

1 cable connector
10 contact
11 fixing section
12 engaging section
13 connection section
20 inner sleeve
30 insulator
31 through hole
40 shell
41 main body section
42 caulking section
43 connection section
50 outer sleeve
51 straight wall section
52 curved wall section
60 housing
61 opening
62 mating piece
63 engaging protrusion
70 cover
71 engaging piece
100 cable
101 internal conductive part
102 internal insulating part
103 braid part
104 external insulating part
131 connection piece

The invention claimed is:

1. A cable connector configured to be connected to a cable including a conductive part and an insulating part covering the conductive part, the cable connector comprising: a conductive contact that is connected to the conductive part; an insulating insulator that holds the contact; a conductive shell that includes a caulking section caulked to the insulating part and covers the insulator; a cylindrical conductive first sleeve that is located in direct contact with the caulking section and caulked to the insulating part via the caulking section; and a conductive second sleeve, wherein the cable connector connects to the cable including the conductive part constituted of an internal conductive part and an external conductive part, and the insulating part constituted of an internal insulating part covering the internal conductive part between the internal conductive part and the external conductive part and an external insulating part covering the external conductive part, the contact is connected to the internal conductive part, the second sleeve is located between the external insulating part and the caulking section and caulked to the external insulating part, the caulking section is caulked to the external insulating part via the second sleeve so that the external conductive part folded back over an outer perimeter of the second sleeve is sandwiched between the caulking section and the second sleeve, and the first sleeve is caulked to the external insulating part with the caulking section and the second sleeve sandwiching the external conductive part therebetween.

2. The cable connector according to claim 1, wherein the first sleeve is seamless in a circumferential direction.

3. A method for manufacturing a cable connector connected to a cable including a conductive part and an insulating part covering the conductive part, the method comprising the steps of: connecting a conductive contact to the conductive part; holding the contact by an insulating insulator; covering the insulator with a main body section of a conductive shell and caulking a caulking section of the shell to the insulating part; locating a cylindrical conductive first sleeve in direct contact with the caulking section and then caulking the first sleeve to the insulating part via the caulking section; connecting the cable connector to the cable including the conductive part constituted of an internal conductive part and an external conductive part, and the insulating part constituted of an internal insulating part covering the internal conductive part between the internal conductive part and the external conductive part and an external insulating part covering the external conductive part; connecting the contact to the internal conductive part; locating a conductive second sleeve between the external insulating part and the caulking section; caulking the second sleeve to the external insulating part; caulking the caulking section to the external insulating part via the second sleeve so that the external conductive part folded back over an outer perimeter of the second sleeve is sandwiched between the caulking section and the second sleeve; and caulking the first sleeve to the external insulating part, the caulking section and the second sleeve sandwiching the external conductive part therebetween.

* * * * *